US011027899B2

(12) United States Patent
Richlowski

(10) Patent No.: US 11,027,899 B2
(45) Date of Patent: Jun. 8, 2021

(54) CLOSURE DEVICE

(71) Applicant: West Pharmaceutical Services Deutschland GmbH & Co. KG, Eschweiler (DE)

(72) Inventor: Kolja Richlowski, Aachen (DE)

(73) Assignee: WEST PHARMACEUTICAL SERVICES DEUTSCHLAND GMBH & CO. KG, Eschweiler (DE)

( * ) Notice: Subject to any disclaimer, the term of this patent is extended or adjusted under 35 U.S.C. 154(b) by 0 days.

(21) Appl. No.: 16/962,651

(22) PCT Filed: Jan. 21, 2019

(86) PCT No.: PCT/US2019/014394
§ 371 (c)(1),
(2) Date: Jul. 16, 2020

(87) PCT Pub. No.: WO2019/144067
PCT Pub. Date: Jul. 25, 2019

(65) Prior Publication Data

US 2020/0354122 A1 Nov. 12, 2020

Related U.S. Application Data

(60) Provisional application No. 62/619,298, filed on Jan. 19, 2018.

(51) Int. Cl.
*B65D 51/00* (2006.01)
*B65D 51/20* (2006.01)
*B65D 51/24* (2006.01)

(52) U.S. Cl.
CPC ..... *B65D 51/002* (2013.01); *B65D 51/20* (2013.01); *B65D 51/241* (2013.01)

(58) Field of Classification Search
CPC ..... B65D 51/241; B65D 51/002; B65D 51/20
(Continued)

(56) References Cited

U.S. PATENT DOCUMENTS 5,314,084 A * 5/1994 Folta ..... B65D 51/241 215/249
5,555,988 A * 9/1996 Koch ..... B65D 51/002 215/249

(Continued)

FOREIGN PATENT DOCUMENTS

CN 1326325 A 12/2001
CN 101402408 A 4/2009

(Continued)

OTHER PUBLICATIONS

Int'l Search Report and Written Opinion dated May 15, 2019 in Int'l Application No. PCT/US2019/014394.

(Continued)

*Primary Examiner* — Ernesto A Grano
(74) *Attorney, Agent, or Firm* — Panitch Schwarze Belisario & Nadel LLP

(57) ABSTRACT

A closure device for closing a container is provided. The closure device (10) includes a ring (28), a cover (30) and a cap (32). The ring has a top wall (34) and a flexible skirt (36) extending downwardly from the top wall. The flexible skirt includes a plurality of spaced-apart first legs (40) and a plurality of spaced-apart second legs (42) arranged in an alternating manner. Each of the first and second legs has a first end at the top wall and an opposing second end. The first legs are different from the second legs. An interior surface of each first leg has a first inwardly protruding ledge (44) between the first and second ends. Each second leg has a second inwardly protruding ledge (48) at the second end. An interior surface of each second leg has a flexible tongue (50)

(Continued)

and a recess (52) configured to receive the flexible tongue. The tongues are adapted to retain an elastomer stopper (14).

19 Claims, 4 Drawing Sheets

(58) Field of Classification Search
USPC ..... 215/247
See application file for complete search history.

(56) References Cited

U.S. PATENT DOCUMENTS

| | | | | |
|---|---|---|---|---|
| 5,957,314 | A * | 9/1999 | Nishida | B65D 45/322 215/249 |
| 8,839,971 | B2 * | 9/2014 | Aneas | B65D 51/002 215/247 |
| 8,950,609 | B2 * | 2/2015 | Aneas | B65D 51/002 215/247 |
| 8,978,909 | B2 * | 3/2015 | Kakutani | B65D 51/002 215/249 |
| 9,361,780 | B2 * | 6/2016 | Burke, Jr. | G08B 21/24 |
| 9,555,941 | B2 * | 1/2017 | Ogawa | A61J 1/1425 |
| 9,802,736 | B2 * | 10/2017 | Fournier | B65D 51/002 |
| 9,815,601 | B2 * | 11/2017 | Browne | A61J 1/1412 |
| 9,956,138 | B2 * | 5/2018 | Ohlin | A61M 39/04 |
| 10,183,791 | B2 * | 1/2019 | Friedrich | B65D 51/002 |
| 10,219,983 | B2 * | 3/2019 | Zelinski | A61J 1/2096 |
| 10,336,515 | B2 * | 7/2019 | Rosson | B65D 41/17 |
| 10,532,005 | B2 * | 1/2020 | Barrelle | A61J 1/201 |
| 10,610,452 | B2 * | 4/2020 | Anelli | A61M 39/22 |

FOREIGN PATENT DOCUMENTS

| | | | |
|---|---|---|---|
| CN | 101909577 | A | 12/2010 |
| CN | 101952179 | A | 1/2011 |
| EP | 1594794 | A1 | 11/2005 |
| FR | 2927316 | A1 | 8/2009 |
| WO | 2004071932 | A1 | 8/2004 |
| WO | 2011039004 | A1 | 4/2011 |
| WO | 2017001459 | A1 | 1/2017 |

OTHER PUBLICATIONS

Office Action dated Apr. 19, 2021 in Chinese Application No. 2019800093257 (Office Action cited to show evidence of relevance, no english translation).

* cited by examiner

CLOSURE DEVICE

CROSS-REFERENCE TO RELATED APPLICATIONS

This application is a section 371 of International Application No. PCT/US2019/014394, filed Jan. 21, 2019, which was published on Jul. 25, 2019 under International Publication No. WO 2019/144067 A1, which claims priority to U.S. Provisional Application No. 62/619,298 titled "Closure Device," filed on Jan. 19, 2018, the entire contents of which are incorporated herein by reference.

BACKGROUND

A closure device for closing a container is provided, which in one embodiment, includes a preassembled stopper. Another embodiment relates to a container equipped with such a closure device. Another embodiment relates to a method of closing and sealing a container using such a closure device.

In the field of containers for medication, a glass bottle can be used to store an active ingredient in freeze-dried form, in powder form, or in the form of a liquid solution. Such a bottle must be closed off in a leak-tight manner, so as to maintain its contents in a satisfactory state of preservation, until the date on which it is used. In order to close a bottle hermetically, a closure device can be used that comprises an elastomer stopper that has the function of being totally sealed against gas, liquids, and bacteria. Such a device further comprises a locking cover that can be made of a plastic material, and that is designed to be held in place around the stopper so as to isolate the stopper from the outside and so as to oppose removal of the stopper.

When using such a closure device for freeze-dried pharmaceutical substances, for example, each container is filled with a quantity of substance for freeze-drying, and then the respective stopper is placed on or in the neck of the container in such a manner as to be secured thereto, while also preserving communication between the outside environment and the inside of the container. Containers filled and pre-stopped in this way are then placed in batches on the shelves of a freeze drier inside which the substances are dehydrated. During freeze-drying of the contents of a container, vacuum cold-drying is performed to help ensure that the water is extracted from the substance by sublimation and evaporation.

Once the substances have been dehydrated within the freeze drier, pressure is applied to all of the stoppers of the containers in such a manner so as to help ensure that the containers are stopped hermetically by each stopper being engaged on or in the neck of the corresponding container. Such stopping in batches is generally performed with the elastomer stopper alone, without the locking cover. After removing the containers from the freeze drier, additional processing is performed to position the locking cover in place on each container. However, it is desirable to avoid such an additional operation. Thus, it has been envisaged to place the corresponding locking cover on each of the stoppers of the pre-stopped containers before freeze drying them, so that the locking covers are also put in place while the stoppers are being pressed into place inside the freeze drier.

Specifically, when the cover needs to be moved so as to be locked around the neck of the corresponding container, friction creates resistance to this movement, the magnitude of which varies as a function firstly of the manufacturing tolerances of the component parts of the cover, and secondly of the pre-positioning of the parts when they are installed on the neck of the container. Thus, when a presser plate is used inside the freeze drier to lock the covers on a large number of corresponding containers, certain covers are not locked correctly in view of the manufacturing tolerances of the component parts of the covers and in view of the operating clearances of the presser plate. Also, the dimensional variations in the containers themselves and in the stoppers that are used further complicate the closure of a batch of containers. In view of these difficulties, the stoppers and the locking covers were not put in place simultaneously on batches of containers inside a freeze drier, and consequently covers were placed subsequent to placement of the stopper. This results in complex and costly operations when packaging freeze-dried substances according to the process described above.

Therefore, it is desirable to use a stopper device which provides for secure and stable positioning of the cover on a vial stopper.

BRIEF SUMMARY OF THE DISCLOSURE

An embodiment of the invention relates to a closure device for closing a container. The closure device comprises a ring, a cover and a cap. The ring comprises a first top wall and a flexible skirt extending downwardly from the first top wall. The first top wall defines a first central through-opening. The flexible skirt comprises a plurality of spaced-apart first legs and a plurality of spaced-apart second legs. Each of the first and second legs has a first end at the first top wall and an opposing second end. The plurality of spaced-apart first legs are different from the plurality of spaced-apart second legs. An interior surface of each first leg has a first inwardly protruding ledge between the first and second ends and an exterior surface of each first leg has a first outwardly protruding ledge between the first and second ends. Each second leg has a second inwardly protruding ledge at the second end. An interior surface of each second leg has a flexible tongue and a recess configured to receive the flexible tongue. The cover comprises a second top wall, a sidewall extending downwardly from the second top wall and an interior cavity defined by the second top wall and the sidewall. The second top wall defines a second central through-opening generally aligned with the first central through-opening of the ring. An interior surface of the sidewall includes a third inwardly protruding ledge. A cap has a raised peripheral rim and a central depressed region. An interior surface of the central depressed region includes a plurality of spaced-apart bent tabs configured to be engaged in the second central through-opening of the cover to couple the cap to the cover. In a first position in which the ring is least partially inserted within the interior cavity of the cover, the third inwardly protruding ledge of the cover engages the first top wall of the ring. In a second position in which the ring is fully inserted within the interior cavity of the cover, the third inwardly protruding ledge of the cover engages the first outwardly protruding ledge of each first leg of the ring.

Another embodiment of the invention relates to an assembly of a container and a closure device for closing the container. The assembly comprises a container and a closure device for closing and sealing the container. The container has a main body, a neck, and a rim defining an opening of the container. The closure device comprises a ring, an elastomer stopper, a cover and a cap. The ring comprises a first top wall, a flexible skirt extending downwardly from the first top wall and a first interior cavity defined by the first top wall and the flexible skirt. The first top wall defines a first central through-opening. The flexible skirt comprises a plurality of spaced-apart first legs and a plurality of spaced-apart second legs. Each of the first and second legs has a first end at the first top wall and an opposing second end. The plurality of spaced-apart first legs are different from the plurality of spaced-apart second legs. An interior surface of each first leg has a first inwardly protruding ledge between the first and second ends and an exterior surface of each first leg has a first outwardly protruding ledge between the first and second ends. Each second leg has a second inwardly protruding ledge at the second end, and an interior surface of each second leg has a flexible tongue and a recess configured to receive the flexible tongue. The elastomer stopper has a head and a cylindrical body extending downwardly from the head. The cover comprises a second top wall, a sidewall extending downwardly from the second top wall and a second interior cavity defined by the second top wall and the sidewall. The second top wall defines a second central through-opening generally aligned with the first central through-opening of the ring. An interior surface of the sidewall including a third inwardly protruding ledge. The cap has a raised peripheral rim and a central depressed region. An inner surface of the central depressed region includes a plurality of spaced-apart bent tabs configured to be engaged in the central through-opening of the cover to couple the cap to the cover. In a first position of the assembly, in which the ring is least partially inserted within the second interior cavity of the cover and the closure device is positioned over the rim of the container, the head of the elastomer stopper is retained within the first interior cavity of the ring between the first top wall of the ring and the flexible tongues of the second legs of the ring, the third inwardly protruding ledge of the cover engages the first top wall of the ring, and the rim of the container is retained between the first inwardly protruding ledges of the first legs and the second inwardly protruding ledges of the second legs of the ring. In a second position of the assembly, in which the ring is fully inserted within the interior cavity of the cover and the closure device is positioned over the rim and the neck of the container, an upper surface of the head of the elastomer stopper abuts the first top wall of the ring, the rim of the container is retained between the head of the elastomer stopper and the first inwardly protruding ledges of the first legs of the ring, the flexible tongues of the second legs of the ring are retracted within the respective recesses, and the third inwardly protruding ledge of the cover engages the first outwardly protruding ledges of the first legs.

Another embodiment of the invention relates to a method of closing and sealing a container using a closure device. The container has a main body, a neck, and a rim defining an opening of the container. The closure device comprises a ring, an elastomer stopper, a cover and a cap. The ring comprises a first top wall, a flexible skirt extending downwardly from the first top wall and a first interior cavity defined by the first top wall and the flexible skirt. The first top wall defines a first central through-opening. The flexible skirt comprises a plurality of spaced-apart first legs and a plurality of spaced-apart second legs. Each of the first and second legs has a first end at the first top wall and an opposing second end. The plurality of spaced-apart first legs are different from the plurality of spaced-apart second legs. An interior surface of each first leg has a first inwardly protruding ledge between the first and second ends, and an exterior surface of each first leg has a first outwardly protruding ledge between the first and second ends. Each second leg has a second inwardly protruding ledge at the second end. An interior surface of each second leg has a flexible tongue and a recess configured to receive the flexible tongue. The elastomer stopper has a head and a cylindrical body extending downwardly from the head. The cover comprises a second top wall, a sidewall extending downwardly from the second top wall and a second interior cavity defined by the second top wall and the sidewall. The second top wall defines a second central through-opening generally aligned with the first central through-opening of the ring. An interior surface of the sidewall includes a third inwardly protruding ledge. The cap has a raised peripheral rim and a central depressed region. An inner surface of the central depressed region includes a plurality of spaced-apart bent tabs configured to be engaged in the central through-opening of the cover to couple the cap to the cover. The method comprises: assembling the closure device by coupling the cap to the cover such that the spaced-apart bent tabs of the cap are engaged with an underside of the second top wall of the cover, coupling the ring and the elastomer stopper by inserting the elastomer stopper into the first interior cavity of the ring such that the flexible tongues of the second legs of the ring engage an underside of the head of the elastomer stopper, inserting the coupled ring and elastomer stopper into the second interior cavity of the cover such that the third inwardly protruding ledge of the cover abuts an underside of a peripheral rim of the first top wall of the ring; placing the assembled closure device on the rim of the container in a first position by inserting the container into the first interior cavity of the ring, such that the rim of the container is retained between the first inwardly protruding ledges of the first legs and the second inwardly protruding ledges of the second legs of the ring and such that the cylindrical body of the elastomer stopper is positioned at an entry of the opening of the container; and transitioning the assembled closure device and the container to a second position from the first position by applying a force to bring the assembled closure device and the container toward each other, such that a top surface of the head of the elastomer stopper abuts the first top wall of the ring, the rim of the container is retained between the head of the elastomer stopper and the first inwardly protruding ledges of the first legs of the ring, the flexible tongues of the second legs of the ring are retracted within the respective recesses, and the third inwardly protruding ledge of the cover engages the first outwardly protruding ledges of the first legs.

BRIEF DESCRIPTION OF THE SEVERAL VIEWS OF THE DRAWINGS

The foregoing summary, as well as the following detailed description will be better understood when read in conjunction with the appended drawings. There are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
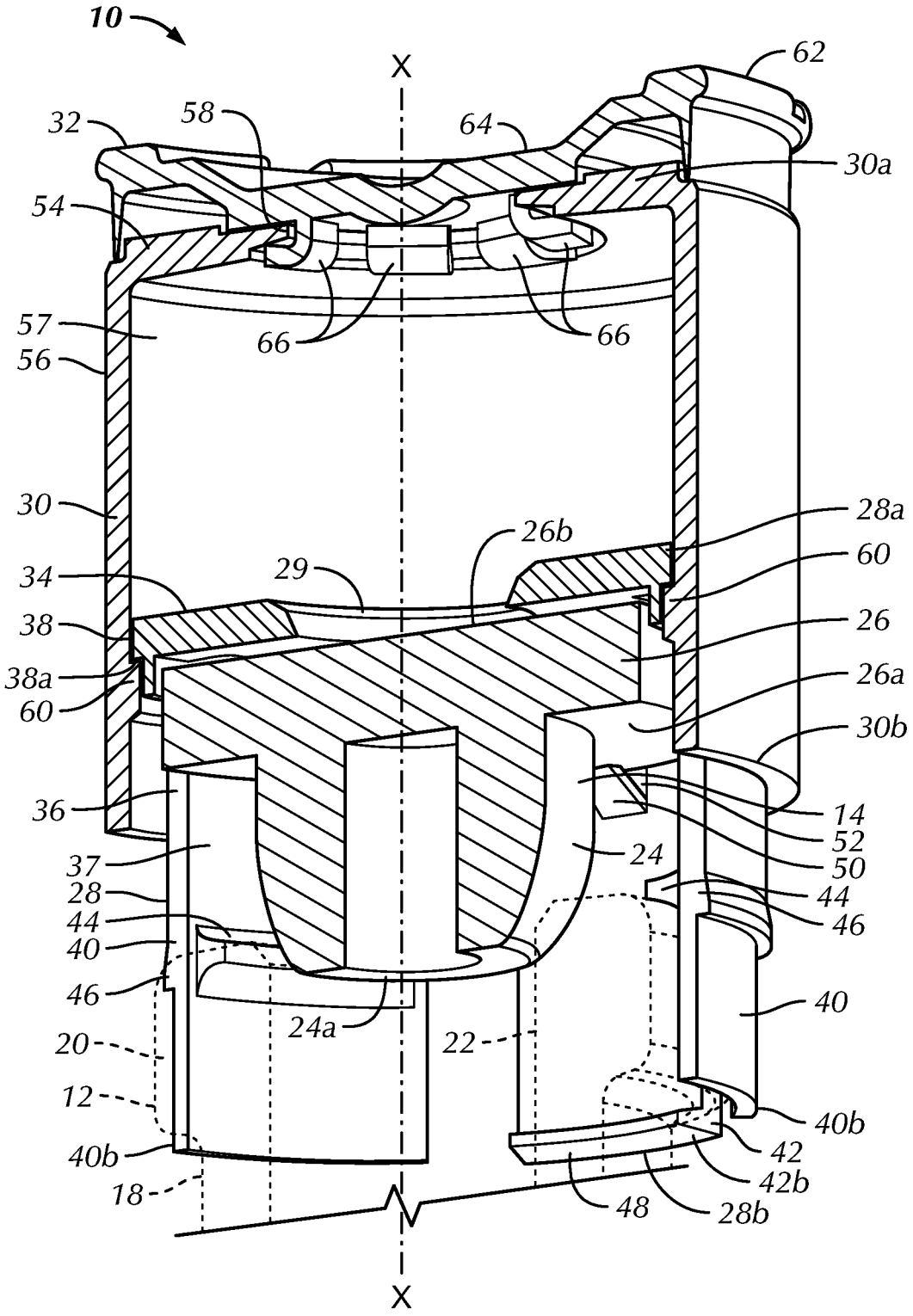
FIG. 1 is a side perspective view of a closure device on a container in a first position, in accordance with an embodiment of the present invention.

Referring to FIGS. 1-4, there is shown a closure device, generally designated by the reference numeral 10, positioned on a container 12 for closure of the container 12 in a leak-tight and secure manner. The container 12 has a main body 16 (see FIG. 3), a neck 18 extending from an upper end of the main body 16, and a rim 20 defining an opening 22 of the container 12 in communication with the neck 18 and body 16. The container 12 may be made of a glass, ceramic or a polymeric material, such as polyethylene (PE) polyethylene terephthalate (PET), glycol-modified polyethylene terephthalate (PETG), high density polyethylene (PEHD) and the like.

The closure device 10 shown in FIGS. 1-4 includes a stopper 14 assembled thereto. The stopper 14 is configured to be positioned at least partially in the container 12. Preferably, the stopper 14 is an elastomer stopper, The stopper 14 is substantially T-shaped in cross-section, and has a cylindrical body 24 and a head 26. The cylindrical body 24 is designed to be positioned within the neck 18 of the container 12. A free end 24*a* of the cylindrical body 24 is preferably tapered. The head 26 defines a peripheral flange for abutting against the top surface of the rim 20 of the container 12.

The closure device 10 is configured to cover the rim 20 and neck 18 of the container 12 with at least a portion of the stopper 14 positioned therein. The closure device 10, and more particularly each component of the closure device 10 as described in detail herein, is preferably made of a plastic material, and more preferably a thermoplastic material such as, but not limited to, PE, PET, PETG, PEHD, polypropylene (PP) or acrylonitrile butadiene styrene (ABS). More preferably, the closure device 10 is made of a pharma grade polypropylene material, and more particularly a pharma grade polypropylene material that is free of contaminants or critical substances (e.g., bisphenol A or formaldehyde).

The closure device 10 comprises a ring 28, a cover 30, and a cap or sealing button 32.

Referring to FIGS. 1-4, the ring 28 has a cylindrical shape has a first end 28*a* and an opposing second end 28*b*. The ring 28 comprises a top wall 34 at its first end 28*a* and cylindrical skirt or sidewall 36, and more particularly a cylindrical skirt or sidewall 36, extending downwardly from the top wall 34 away from the first end 28*a*. The ring 28 has an interior cavity 37 defined by the top wall 34 and the skirt 36. The second end 28*b* of the ring 28 is an open end. The top wall 34 includes an opening 29 at its geometric center. The central opening 29 extends completely through the top wall 34 and is configured to be generally aligned with the opening 22 of the container 12. The top wall 34 has a diameter that is substantially the same as or at least slightly greater than a diameter of the skirt 36. Preferably, the diameter of the top wall 34 is at least slightly greater than the diameter of the skirt 36, such that a peripheral rim 38 of the top wall 34 juts out from a vertical plane of the skirt 36 and defines a peripheral flange.

The skirt 36 is preferably comprised of a plurality of spaced-apart first walls or legs 40 and a plurality of spaced-apart second walls or legs 42. In a preferred embodiment, the plurality of spaced-apart first legs 40 includes three first legs 40 and the plurality of spaced-apart second legs 42 includes three second legs 42, meaning a total of six spaced-apart first and second legs 40, 42 form the skirt 36. Each first leg 40 and each second leg 42 has a first or proximal end 40*a*, 42*a* integrally formed with or attached to the top wall 34 and an opposing second or distal end 40*b*, 42*b* which is a free end. The first and second legs 40, 42 are elastically deformable, and more particularly radially deformable (inwardly or outwardly) relative to a central longitudinal axis X of the skirt 36. The central longitudinal axis X of the skirt 36 also defines a central longitudinal axis of the overall closure device 10. The first and second legs 40, 42 are preferably arranged in an alternating fashion relative to each other, meaning that each first leg 40 is positioned between two of the second legs 42 and, similarly, each second leg 42 is positioned between two of the first legs 40. As such, the skirt 36 is formed of alternating first legs 40 and second legs 42.

An interior surface of each first leg 40 includes a rib or ledge 44 protruding inwardly toward the interior cavity 37 of the ring 28. Each ledge 44 defines a catch designed to engage the rim 20 of the container 12, for example, during a treatment process, and during final closure and sealing of the container 12, as described in more detail herein. The ledge 44 is preferably provided at an intermediate position between the first and second ends 40*a*, 40*b* of each first leg 40 (i.e., each ledge 44 is distal from both the first and second ends 40*a*, 40*b* of the respective first leg 40). The ledges 44 of the first legs 40 are referred to hereinafter as upper ledges 44. An exterior surface of each first leg 40 includes a ledge 46 protruding outwardly away from the interior cavity 37 of the ring 28. Preferably, the ledge 46 of each first leg 40 is provided at a corresponding position to the upper ledge 44 of the respective first leg 40. Such an outwardly protruding ledge 46 may also be provided on the exterior surface of each second leg 42 at the same position and orientation, such that the plurality of outwardly protruding ledges 46 collectively define an annular outwardly protruding ledge.

The first legs 40 and second legs 42 are different from each other. More particularly, the second legs 42 do not include the same type of intermediately-positioned ledge 44 as the first legs 40. Rather, at or proximate the second end 42*b* of each second leg 42, each second leg 42 includes or is formed as a rib or ledge 48 which protrudes inwardly toward the interior cavity 37 of the ring 28. As such, the ledge 48 of each second leg 42 defines another catch designed to engage the rim 20 of the container 12, for example, during a treatment process, as described in more detail herein. The ledges 48 of the second legs 42 are referred to hereinafter as lower ledges 48. The distance between the upper ledges 44 of the first legs 40 and the lower ledges 48 of the second legs 42 is generally equal to or at least slightly larger than the height of the rim 20 of the container 12.

The interior surface of each second leg 42 further comprises a tongue 50 (alternatively may be referred to as a tab, prong, tooth and the like), and more particularly a flexible tongue 50, and a corresponding recess 52 configured to receive the tongue 50 when the tongue 50 is in a retracted configuration. Each tongue 50 is cantilevered and is inclined with respect to the interior surface of the respective second leg 42. Each tongue 50 is biased at such an incline toward the interior cavity 37 of the ring 28. The tongue 50 is provided at an intermediate position between the first and second ends 42*a*, 42*b* of each second leg 42. More particularly, the distance between the top wall 34 (i.e., the first ends 42*a* of the second legs 42) and the flexible tongues 50 is generally equal to or at least slightly larger than a height of the head 26 of the stopper 14.

Referring to FIGS. 1-4, the cover 30 also has a generally cylindrical body and has a first end 30*a* and an opposing second end 30*b*. The cover 30 comprises a top wall 54 at its first end 30*a* and a skirt or sidewall 56, and more particularly a cylindrical skirt or sidewall 56, extending downwardly from the top wall 54 away from the first end 30*a*. The cover 30 has an interior cavity 57 defined by the top wall 54 and the skirt 56. The opposing second end 30*b* of the cover 30 is an open end. The top wall 54 is generally a closed wall, except for an opening 58 provided at its geometric center. The central opening 58 extends completely through the top wall 54 and is configured to be generally aligned coaxially with the opening 22 of the container 12 and the opening 29 of the ring 28. The interior cavity 57 of the cover 30 preferably has a diameter (i.e., inner diameter of the cover 30) that is at least slightly greater than an outer diameter of the ring 28, such that the ring 28 is configured to be received within the interior cavity 57 of the cover 30.

An interior surface of the skirt 56 of the cover 30 preferably includes a rib or ledge 60 which protrudes inwardly toward the interior cavity 57 of the cover 30. More particularly, the ledge 60 is an annular ledge. The ledge 60 defines a catch designed to engage the peripheral rim 38 of the top wall 34 of the ring 28 in a first position (for example, during a treatment process), and to engage the outwardly protruding ledges 46 of the first legs 40 and/or second legs 42 in a second position (for example, in a closed or sealed position), as described in more detail herein. The inwardly protruding ledge 60 is preferably provided closer to the open second end 30*b* of the cover 30 than to the first end 30*a*.

Referring to FIGS. 1-4, the cap 32 is preferably generally circular in cross-section, and comprises a raised peripheral rim 62 and a central depressed region 64. An interior surface of the central depressed region 64 includes a plurality of spaced-apart bent tabs 66 configured to be engaged in the central opening 58 of the cover 30. That is, in the engaged position, the bent tabs 66 extend through the central opening 58 and abut the underside (or interior surface) of the top wall 54 of the cover 30. As such, the bent tabs 66 serve to couple the cap 32 to the cover 30. Thus, the cap 32 closes off the opening 58 of the cover 30 (as well as the opening 29 of the ring 28) and, before it is removed, opposes any access to the stopper 14 via the openings 58, 29.

In one embodiment, the cap 32 includes an elastically deformable connecting web in the area between the peripheral rim 62 and the central depressed region 64, such that the peripheral rim 62 may be configured to move axially under drive from an axial pressure or force. Thus, the peripheral rim 62 may be configured to move between a raised position and a lowered position. In one embodiment, the peripheral rim 62 is also be biased to the raised position, such that the peripheral rim 62 automatically returns to the raised position when a pressure or force ceases to be applied to it.

The cap 32 functions as a spring element, and more particularly a flexible spring element, which provides for at least partial compensation of the heights of the stacked components of the assembly. More particularly, the cap 32 allows for the partial compensation of different heights of the various stacked components (e.g., the container 12, the stopper 14 and the closure device 10) of the assembly, and therefore reduces the risk of breakage of the container 12 during a treatment process. This benefit is particularly advantageous in the context of glass containers 12 being used in a lyophilization process.

However, it will be understood by those skilled in the art that the closure device 10 of the present invention may be utilized on a container made of any type of material and may be used in conjunction with a container for any type of treatment process (e.g., sterilization process, filling process and the like), and is in no way limited to glass containers and a lyophilization (freeze-drying) process.

When the cap 32 is removed by a user, a part of the upper (or exterior) surface 26*b* of the head 26 of the stopper 14 is exposed through the openings 58 and 29. The stopper 14 may thus be pierced, for example, by a needle of a syringe (not shown) for introducing a liquid solvent or diluent into the container 12 and/or drawing out a liquid drug product from the container 12.

A description of one of the methods for assembling the closure device 10 follows. The successive steps which may be utilized for joining the closure device 10 (including the stopper 14 pre-assembled therewith) together with the container 12 (e.g., for pre-assembly or for a treatment process, in a first position) and, finally, for closing the container 12 in a sealed manner by the closure device 10 (i.e., a second position) are also described.

Figure 2:
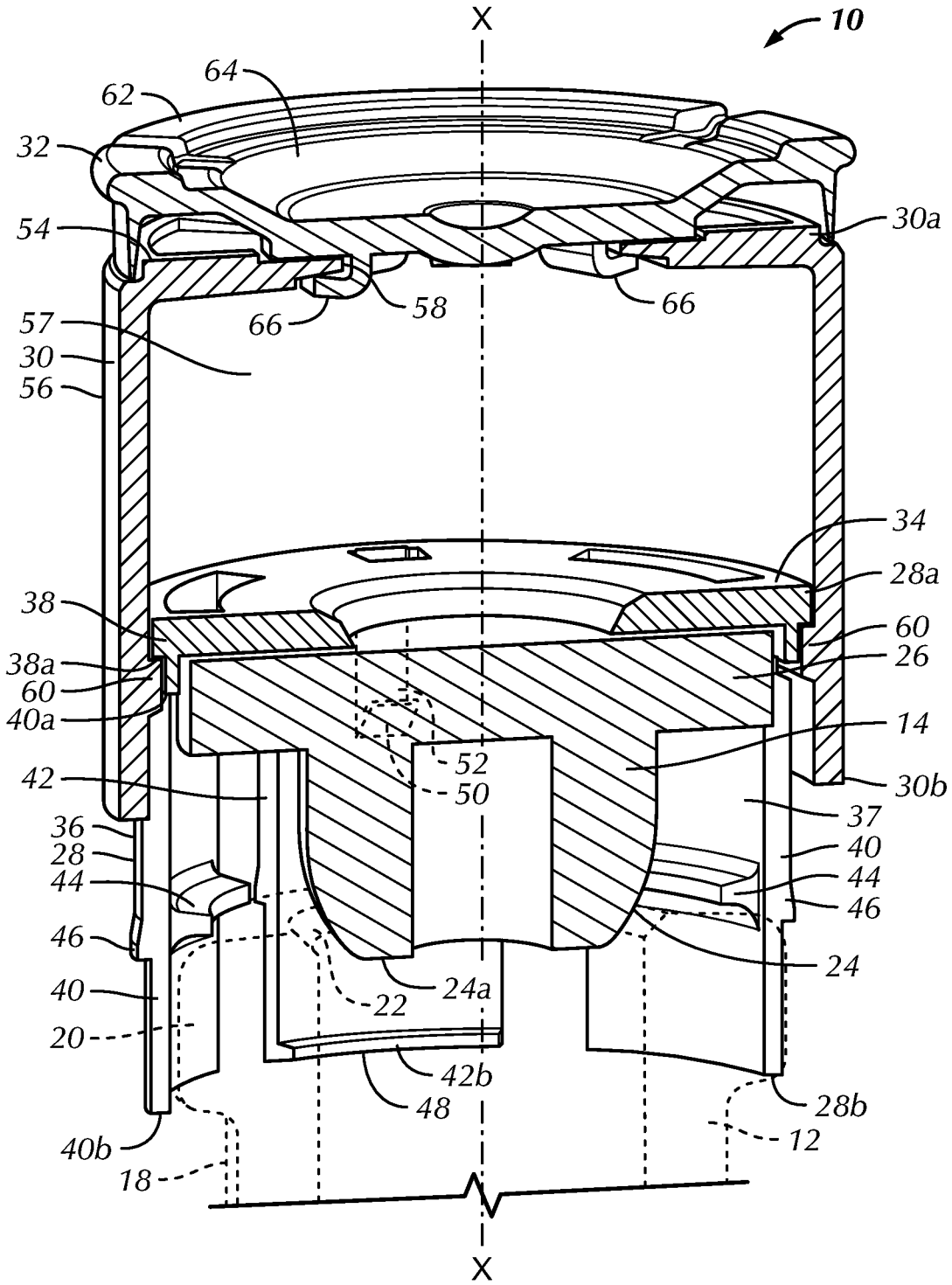
FIG. 2 is a front perspective view of the closure device on the container in the first position, in accordance with an embodiment of the present invention.
Figure 3:
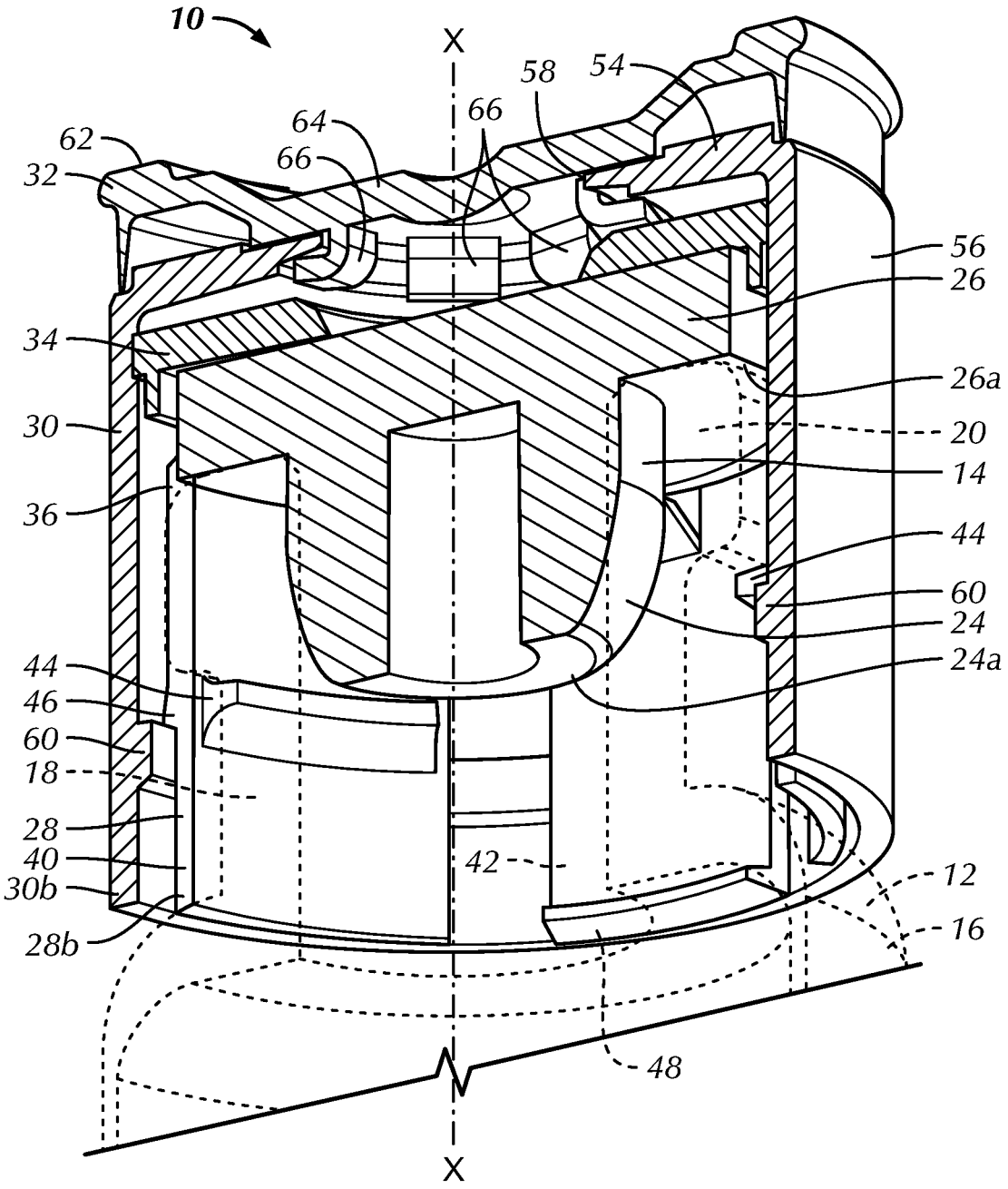
FIG. 3 is a side perspective view of the closure device on the container in a second position, in accordance with an embodiment of the present invention.
Figure 4:
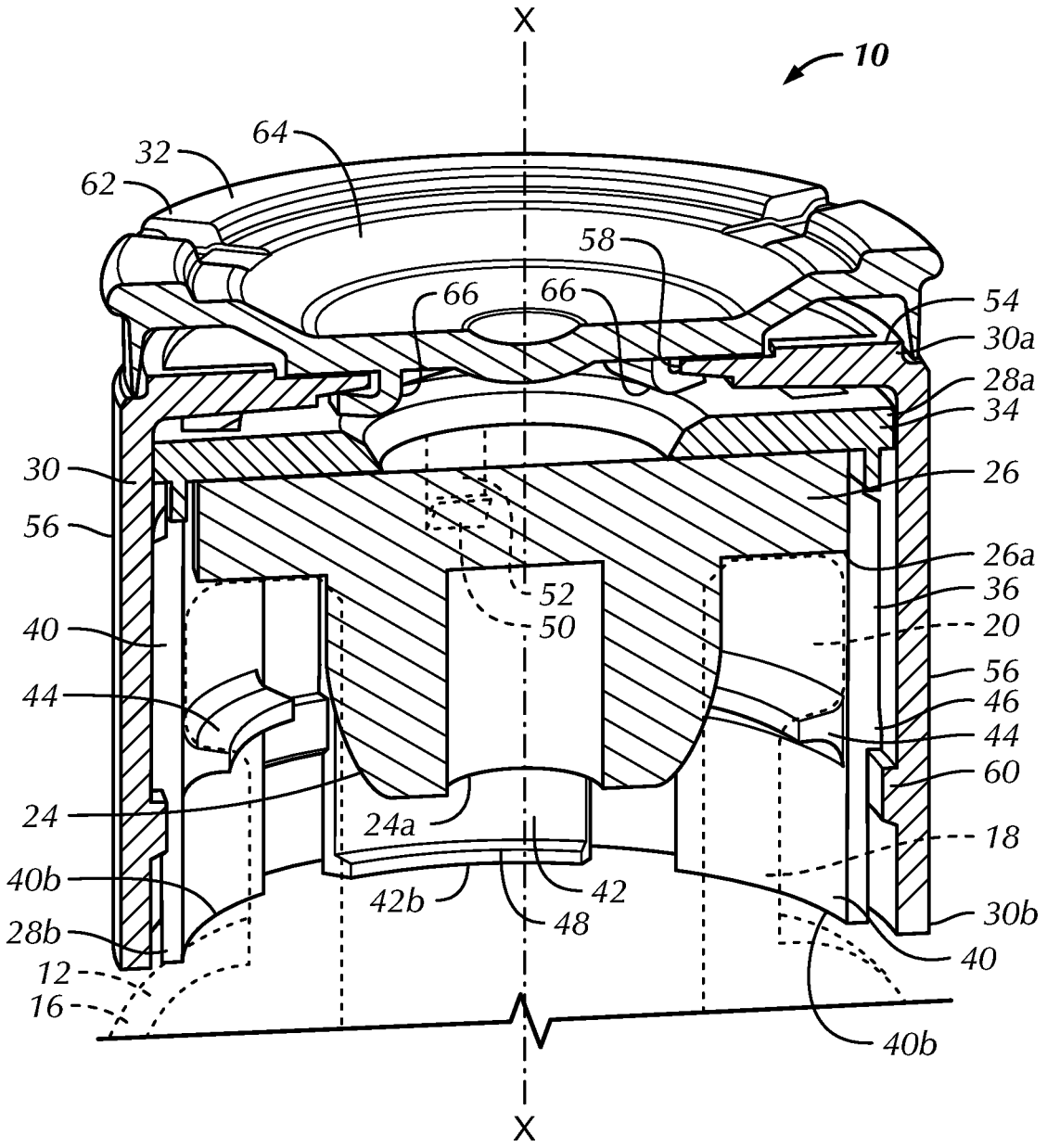
FIG. 4 is a front perspective view of the closure device on the container in the second position, in accordance with an embodiment of the present invention.

During assembly of the closure device 10, the stopper 14 is positioned within the ring 28, as shown in FIGS. 1-2. More particularly, the stopper 14 is inserted into the interior cavity 37 of the ring 28 via the bottom end 28*b* and pushed in an upward direction toward the first end 28*a* and the top wall 34. By this insertion motion, the head 26 of the stopper 14 comes into contact with the surfaces of the tongues 50. As the head 26 of the stopper 14 passes over the tongues 50, the head 26 causes the tongues 50 to flex toward and retract inside of the respective recesses 52. After the head 26 of the stopper 14 has moved past the tongues 50, the tongues 50 spring back out of the recesses 52 and return to their previously biased position (i.e., to extend inwardly toward the interior cavity 37 and out of the recesses 52), and then engage the head 26 of the stopper 14. More particularly, the tongues 50 snap back to engage the underside (i.e., the lower or interior surface 26*a*) of the head 26 of the stopper 14, so as to retain the stopper 14 between the tongues 50 and the top wall 34, as shown in FIGS. 1-2. More particularly, in this pre-assembly position, the upper surface 26*b* of the head 26 of the stopper 14 faces, and may even abut or be in direct contact with, the top wall 34 of the ring 28. As such, the stopper 14 is secured within the ring 28, between and by the top wall 34 and the tongues 50 of the second legs 42 of the skirt 36 of the ring 28.

Next, the ring 28, with the stopper 14 secured therein, is partially inserted into the interior cavity 57 of the cover 30 through the open second end 30*b*. In one embodiment, prior to the partial insertion of the assembled ring 28 and stopper 14 into the interior cavity 57 of the cover 30, the cap 32 has already been coupled to the cover 30, as described above, such that the spaced-apart tabs 66 of the cap 32 are engaged with the underside of the top wall 54 of the cover 30.

The process of partially inserting the assembled ring 28 and stopper 14 into the interior cavity 57 of the cover 30 will now be described. Specifically, starting with the top wall 34, the assembled ring 28 and stopper 14 pass through the open second end 30*b* of the cover 30 and are pushed in an upward direction toward the top wall 54 of the cover 30 (or vice versa the cover 30 is pushed in a downward direction toward the top wall 34 of the ring 28). This insertion motion continues until the peripheral flange 38 of the top wall 34 of the ring 28 passes over and then comes to rest on the inwardly protruding ledge 60 of the cover 30. During the insertion motion, the skirt 36 of the ring 28, and more particularly the first and second legs 40, 42, may deform at least slightly radially inwardly. In an assembled position, the peripheral flange 38 of the top wall 34 of the ring 28 is positioned above and on the inwardly protruding ledge 60 of the cover 30, such that ledge 60 of the cover 30 abuts and directly contacts the lower surface or underside 38*a* of the peripheral flange 38. As such, a portion of the assembled ring 28 and stopper 14 is received within the interior cavity 57 of the cover 30, while the remaining portion of the assembled ring 28 and stopper 14 is positioned outside of the cover 30, as shown in FIGS. 1-2.

At this stage, the closure device 10 is in its assembled position or state. The assembled closure device 10 may then be subjected to a preliminary treatment process, such as a sterilization process.

Next, the assembled closure device 10 is positioned on the container 12 in a first position, as shown in FIGS. 1-2. To do so, the assembled closure device 10 is positioned over the container 12, such that the rim 20 of the container 12 is received within the ring 28. More particularly, the assembled closure device 10 is pushed in a downward direction over the container rim 20 (or vice versa the container 12 is pushed in an upward direction toward the top wall 34 of the ring 28) until the container rim 12 is positioned between the upper ledges 44 of the first legs 40 and the lower ledges 48 of the second legs 42 of the skirt 36 of the ring 28. As such, the container rim 12 is secured within the ring 28 and serves to center the assembled closure device 10 and the container 12 relative to each other, such that the assembled closure device 10 is held in a stable manner on the container 12. In this first position, the tapered end 24*a* of the cylindrical body 24 of the stopper 14 is positioned at the entry of the opening 22 of the container 12, but the cylindrical body 24 itself may not yet be fully received within the opening 22 of the container 12.

As such, in the first position, the assembled closure device 10 and container 12 joined thereto may be subjected to one or more of a variety of treatment processes. As a non-limiting example, the assembled closure device 10 and container 12 joined thereto, in the first position, may be subjected to a lyophilization (i.e., freeze-drying) process. Because the cylindrical body 24 or the tapered end 24*a* of the stopper 14 is not yet inserted within the opening 22 of the container 12, gases or vapors which form during the treatment process, are able to escape from the container 12.

After the treatment process or processes are complete, the container 12 can be finally closed and sealed by the closure device 10 (i.e., placed into the second position). It will be understood by those skilled in the art that the processes described herein may be simultaneously carried out on multiple containers 12 and closure devices 10, providing for bulk assembly, treatment and closure.

To effect complete closure and sealing of the container 12, after the treatment process is complete, pressure or force (e.g., by a pressing plate) may be exerted in a downward direction on the cap 32, and this pressure or force then translates through the closure device 10. Alternatively, pressure or force may be exerted in an upward direction on the container 12, which in turn exerts pressure or force in an upward direction on the closure device 10. The following discussion regarding closure of the container 12 relates to the embodiment wherein force is exerted in the downward direction on the cap 32, but it will be understood by those skilled in the art that the relative movement of the closure device 10 and container 12 should be the same regardless of the direction of application of pressure or force.

For example, when pressure or force is applied in the downward direction on the cap 32, the pressure/force causes the container rim 20 to come out of the annular seat defined by the upper ledges 44 of the first legs 40 and the lower ledges 48 of the second legs 42 of the ring 28, and moves in an upward direction toward the top wall 34 of the ring 28 and past the upper ledges 44 of the first legs 40 and the flexible tongues 50 of the second legs 42. During this upward motion, the cylindrical body 24 of the stopper 14 simultaneously moves into the opening 22 of the container 12, and the container rim 20 comes into contact with the surfaces of the flexible tongues 50, thus causing the tongues 50 to again retract inside the respective recesses 52. This motion continues until the cylindrical body 24 of the stopper 14 is fully received within the opening 22 of the container 12, and until the container rim 20 rests against the underside 26*a* of the head 26 of the stopper 14 and is secured within the area between the underside 26*a* of the head 26 of the stopper 14 and the upper ledges 44 of the first legs 40. In parallel to movement of the stopper 14, the first legs 40 deform or bend radially outwardly until the inner diameter of the upper ledges 44 equals the outer diameter of the container rim 20 of the container 12. The first legs 40 will deform or bend radially inwardly again, once the stopper 14 is pushed into the opening 22 of the container 12, such that the upper ledges 44 of the first legs 44 engage the underside of the container rim 20 for final container fixation.

To help prevent particles of the plastic material of the closure device 10 from entering the container 12, the relative movement between the cover 30 and the ring 28 may start once the stopper 14 is completely pushed into the opening 22 of the container 12. This pressure/force also causes the inwardly protruding ledge 60 of the cover 30 and the peripheral flange 38 of the ring 28 to come out of engagement with each other, and the cover 30 to move in a downward direction toward the container 12 until the inwardly protruding ledge 60 engages and abuts against the outwardly protruding ledges 46 of the ring 28, and until the top wall 34 of the ring 28 is proximate (or abuts) the top wall 54 of the cover 30.

At this stage, the closure device 10 is securely locked to the container 12, such that the container 12 is closed and sealed in a secure and leak-tight manner.

Certain terminology is used in the following description for convenience only and is not limiting. The words "proximal," "distal," "upward," "downward," "bottom" and "top" designate directions in the drawings to which reference is made. The words "inwardly" and "outwardly" refer to directions toward and away from, respectively, a geometric center of the closure device and container and/or designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A closure device for closing a container, the closure device comprising:

a ring comprising a first top wall and a flexible skirt extending downwardly from the first top wall, the first top wall defining a first central through-opening, the flexible skirt comprising a plurality of spaced-apart first legs and a plurality of spaced-apart second legs, each of the plurality of spaced-apart first legs and the plurality of spaced-apart second legs having a first end at the first top wall and an opposing second end, the plurality of spaced-apart first legs being different from the plurality of spaced-apart second legs, an interior surface of each spaced-apart first leg having a first inwardly protruding ledge between the first end and the opposing second end and an exterior surface of each spaced-apart first leg having a first outwardly protruding ledge between the first end and the opposing second end, each spaced-apart second leg having a second inwardly protruding ledge at the opposing second end, an interior surface of each spaced-apart second leg having a flexible tongue and a recess configured to receive the flexible tongue;

a cover comprising a second top wall, a sidewall extending downwardly from the second top wall and an interior cavity defined by the second top wall and the sidewall, the second top wall defining a second central through-opening generally aligned with the first central through-opening of the ring, an interior surface of the sidewall including a third inwardly protruding ledge; and a cap having a raised peripheral rim and a central depressed region, an interior surface of the central depressed region including a plurality of spaced-apart bent tabs configured to be engaged in the second central through-opening of the cover to couple the cap to the cover, wherein, in a first position in which the ring is at least partially inserted within the interior cavity of the cover, the third inwardly protruding ledge of the cover engages the first top wall of the ring, and wherein, in a second position in which the ring is fully inserted within the interior cavity of the cover, the third inwardly protruding ledge of the cover engages the first outwardly protruding ledge of each spaced-apart first leg of the ring.

2. The closure device according to claim 1, wherein plurality of spaced-apart first legs and the plurality of spaced-apart second legs are arranged in an alternating configuration relative to each other.

3. The closure device according to claim 1, wherein the ring, the cover and the cap are made of a thermoplastic material.

4. The closure device according to claim 3, wherein the ring, the cover and the cap are made of a pharma grade polypropylene material.

5. The closure device according to claim 1, further comprising an elastomer stopper having a head and a cylindrical body extending downwardly from the head, wherein, in the first position, the head of the elastomer stopper is retained between the first top wall of the ring and the flexible tongues of the plurality of spaced-apart second legs.

6. The closure device according to claim 1, wherein an exterior surface of each spaced-apart second leg of the ring has a second outwardly protruding ledge between the first end and the opposing second end.

7. The closure device according to claim 6, wherein, in the second position, the third inwardly protruding ledge of the cover engages the second outwardly protruding ledge of each spaced-apart second leg of the ring.

8. The closure device according to claim 1, wherein the first top wall of the ring has a diameter that is at least slightly greater than a diameter of the flexible skirt, such that a peripheral rim of the first top wall of the ring defines a peripheral flange.

9. The closure device according to claim 8, wherein, in the first position, the third inwardly protruding ledge of the cover engages the peripheral flange of the first top wall of the ring.

10. An assembly of a container and a closure device for closing the container, the assembly comprising:

a container having a main body, a neck, and a rim defining an opening of the container; and a closure device for closing and sealing the container, the closure device comprising:

a ring comprising a first top wall, a flexible skirt extending downwardly from the first top wall and a first interior cavity defined by the first top wall and the flexible skirt, the first top wall defining a first central through-opening, the flexible skirt comprising a plurality of spaced-apart first legs and a plurality of spaced-apart second legs, each of the plurality of spaced-apart first legs and the plurality of spaced-apart second legs having a first end at the first top wall and an opposing second end, the plurality of spaced-apart first legs being different from the plurality of spaced-apart second legs, an interior surface of each spaced-apart first leg having a first inwardly protruding ledge between the first end and the opposing second end and an exterior surface of each spaced-apart first leg having a first outwardly protruding ledge between the first end and the opposing second end, each spaced-apart second leg having a second inwardly protruding ledge at the opposing second end, an interior surface of each spaced-apart second leg having a flexible tongue and a recess configured to receive the flexible tongue, an elastomer stopper having a head and a cylindrical body extending downwardly from the head, a cover comprising a second top wall, a sidewall extending downwardly from the second top wall and a second interior cavity defined by the second top wall and the sidewall, the second top wall defining a second central through-opening generally aligned with the first central through-opening of the ring, an interior surface of the sidewall including a third inwardly protruding ledge, and a cap having a raised peripheral rim and a central depressed region, an inner surface of the central depressed region including a plurality of spaced-apart bent tabs configured to be engaged in the central through-opening of the cover to couple the cap to the cover, wherein, in a first position of the assembly, in which the ring is at least partially inserted within the second interior cavity of the cover and the closure device is positioned over the rim of the container, the head of the elastomer stopper is retained within the first interior cavity of the ring between the first top wall of the ring and the flexible tongues of the plurality of spaced-apart second legs of the ring, the third inwardly protruding ledge of the cover engages the first top wall of the ring, and the rim of the container is retained between the first inwardly protruding ledges of the plurality of spaced-apart first legs and the second inwardly protruding ledges of the plurality of spaced-apart second legs of the ring, and wherein, in a second position of the assembly, in which the ring is fully inserted within the interior cavity of the cover and the closure device is positioned over the rim and the neck of the container, an upper surface of the head of the elastomer stopper abuts the first top wall of the ring, the rim of the container is retained between the head of the elastomer stopper and the first inwardly protruding ledges of the plurality of spaced-apart first legs of the ring, the flexible tongues of the plurality of spaced-apart second legs of the ring are retracted within the respective recesses, and the third inwardly protruding ledge of the cover engages the first outwardly protruding ledges of the plurality of spaced-apart first legs.

11. The assembly according to claim 10, wherein the plurality of spaced-apart first legs and the plurality of spaced-apart second legs are arranged in an alternating configuration relative to each other.

12. The assembly according to claim 10, wherein the ring, the cover and the cap are made of a thermoplastic material.

13. The assembly according to claim 12, wherein the ring, the cover and the cap are made of a pharma grade polypropylene material.

14. The assembly according to claim 10, wherein an exterior surface of each spaced-apart second leg of the ring has a second outwardly protruding ledge between the first end and the opposing second end.

15. The assembly according to claim 14, wherein, in the second position, the third inwardly protruding ledge of the cover engages the second outwardly protruding ledge of each spaced-apart second leg of the ring.

16. The assembly according to claim 10, wherein the first top wall of the ring has a diameter that is at least slightly greater than a diameter of the flexible skirt, such that a peripheral rim of the first top wall of the ring defines a peripheral flange.

17. The assembly according to claim 16, wherein, in the first position, the third inwardly protruding ledge of the cover engages the peripheral flange of the first top wall of the ring.

18. The assembly according to claim 10, wherein the container, the elastomer stopper and the closure device are arranged in a stacked configuration, and wherein the cap functions as a flexible spring element which provides for at least partial compensation of different heights of the stacked container, elastomer stopper and closure device.

19. A method of closing and sealing a container using a closure device, the container having a main body, a neck, and a rim defining an opening of the container; and the closure device comprising:

a ring comprising a first top wall, a flexible skirt extending downwardly from the first top wall and a first interior cavity defined by the first top wall and the flexible skirt, the first top wall defining a first central through-opening, the flexible skirt comprising a plurality of spaced-apart first legs and a plurality of spaced-apart second legs, each of the plurality of spaced-apart first legs and the plurality of spaced-apart second legs having a first end at the first top wall and an opposing second end, the plurality of spaced-apart first legs being different from the plurality of spaced-apart second legs, an interior surface of each spaced-apart first leg having a first inwardly protruding ledge between the first end and the opposing second end and an exterior surface of each spaced-apart first leg having a first outwardly protruding ledge between the first end and the opposing second end, each spaced-apart second leg having a second inwardly protruding ledge at the opposing second end, an interior surface of each spaced-apart second leg having a flexible tongue and a recess configured to receive the flexible tongue, an elastomer stopper having a head and a cylindrical body extending downwardly from the head, a cover comprising a second top wall, a sidewall extending downwardly from the second top wall and a second interior cavity defined by the second top wall and the sidewall, the second top wall defining a second central through-opening generally aligned with the first central through-opening of the ring, an interior surface of the sidewall including a third inwardly protruding ledge, and a cap having a raised peripheral rim and a central depressed region, an inner surface of the central depressed region including a plurality of spaced-apart bent tabs configured to be engaged in the central through-opening of the cover to couple the cap to the cover, the method comprising:

assembling the closure device by coupling the cap to the cover such that the spaced-apart bent tabs of the cap are engaged with an underside of the second top wall of the cover, coupling the ring and the elastomer stopper by inserting the elastomer stopper into the first interior cavity of the ring such that the flexible tongues of the plurality of spaced-apart second legs of the ring engage an underside of the head of the elastomer stopper, inserting the coupled ring and elastomer stopper into the second interior cavity of the cover such that the third inwardly protruding ledge of the cover abuts an underside of a peripheral rim of the first top wall of the ring;

placing the assembled closure device on the rim of the container in a first position by inserting the container into the first interior cavity of the ring, such that the rim of the container is retained between the first inwardly protruding ledges of the plurality of spaced-apart first legs and the second inwardly protruding ledges of the plurality of spaced-apart second legs of the ring and such that the cylindrical body of the elastomer stopper is positioned at an entry of the opening of the container; and transitioning the assembled closure device and the container to a second position from the first position by applying a force to bring the assembled closure device and the container toward each other, such that a top surface of the head of the elastomer stopper abuts the first top wall of the ring, the rim of the container is retained between the head of the elastomer stopper and the first inwardly protruding ledges of the plurality of spaced-apart first legs of the ring, the flexible tongues of the plurality of spaced-apart second legs of the ring are retracted within the respective recesses, and the third inwardly protruding ledge of the cover engages the first outwardly protruding ledges of the plurality of spaced-apart first legs.

* * * * *